US010400194B2

(12) United States Patent
Olson et al.

(10) Patent No.: US 10,400,194 B2
(45) **Date of Patent: *Sep. 3, 2019**

(54) DETERGENT COMPOSITION INCLUDING A SACCHARIDE OR SUGAR ALCOHOL

(71) Applicant: Ecolab USA Inc., Saint Paul, MN (US)

(72) Inventors: Erik C. Olson, Eagan, MN (US); Carter M. Silvernail, Burnsville, MN (US)

(73) Assignee: Ecolab USA Inc., Saint Paul, MN (US)

( * ) Notice: Subject to any disclaimer, the term of this patent is extended or adjusted under 35 U.S.C. 154(b) by 102 days.

This patent is subject to a terminal disclaimer.

(21) Appl. No.: 15/423,083

(22) Filed: Feb. 2, 2017

(65) Prior Publication Data

US 2017/0145350 A1 May 25, 2017

Related U.S. Application Data

(63) Continuation of application No. 14/340,127, filed on Jul. 24, 2014, now Pat. No. 9,598,660, which is a continuation of application No. 13/268,488, filed on Oct. 7, 2011, now Pat. No. 8,822,403.

(60) Provisional application No. 61/434,668, filed on Jan. 20, 2011.

(51) Int. Cl.

| | |
|---|---|
| ***C11D 3/08*** | (2006.01) |
| ***C11D 3/10*** | (2006.01) |
| ***C11D 3/22*** | (2006.01) |
| ***C11D 3/37*** | (2006.01) |
| ***C11D 7/12*** | (2006.01) |
| ***C11D 7/14*** | (2006.01) |
| ***C11D 11/00*** | (2006.01) |
| ***C11D 17/00*** | (2006.01) |
| ***B08B 9/20*** | (2006.01) |
| ***C11D 7/04*** | (2006.01) |
| ***C11D 3/20*** | (2006.01) |
| ***C11D 7/26*** | (2006.01) |

(52) U.S. Cl.

CPC ..... *C11D 3/221* (2013.01); *C11D 3/08* (2013.01); *C11D 3/10* (2013.01); *C11D 3/2065* (2013.01); *C11D 3/3761* (2013.01); *C11D 7/04* (2013.01); *C11D 7/14* (2013.01); *C11D 7/262* (2013.01); *C11D 17/0047* (2013.01); *C11D 17/0056* (2013.01)

(58) Field of Classification Search

None

See application file for complete search history.

(56) References Cited

U.S. PATENT DOCUMENTS

| | | | | |
|---|---|---|---|---|
| 4,289,643 | A | 9/1981 | Joubert | |
| 4,536,319 | A | 8/1985 | Payne | |
| 4,888,123 | A | 12/1989 | Price et al. | |
| 4,966,606 | A * | 10/1990 | Garner-Gray | C11D 3/10 106/465 |
| 5,114,611 | A | 5/1992 | Van Kralingen et al. | |
| 5,194,172 | A | 3/1993 | Taneri | |
| 5,575,840 | A | 11/1996 | Dewacker | |
| 5,904,735 | A | 5/1999 | Gutierrez et al. | |
| 5,955,415 | A | 9/1999 | Gutierrez et al. | |
| 6,017,864 | A | 1/2000 | Brittain et al. | |
| 6,365,568 | B1 | 4/2002 | Olson et al. | |
| 6,376,440 | B1 | 4/2002 | Hennen et al. | |
| 6,613,733 | B1 | 9/2003 | Barnabas | |
| 7,645,731 | B1 | 1/2010 | Silvernail et al. | |
| 8,216,989 | B2 | 7/2012 | Silvernail et al. | |
| 8,263,540 | B2 | 9/2012 | Olson et al. | |
| 8,822,403 | B2 | 9/2014 | Olson | |
| 2002/0022584 | A1 | 2/2002 | Assmann et al. | |
| 2002/0080809 | A1 | 7/2002 | Guo et al. | |
| 2003/0203828 | A1 | 10/2003 | Bachmann et al. | |
| 2004/0005994 | A1 | 1/2004 | Eskuchen et al. | |
| 2005/0256016 | A1 * | 11/2005 | Oh | C11D 3/38654 510/312 |
| 2007/0179073 | A1 | 8/2007 | Smith et al. | |
| 2008/0188300 | A1 | 8/2008 | Schinkel et al. | |
| 2009/0082248 | A1 | 3/2009 | Jones | |
| 2009/0102085 | A1 * | 4/2009 | Stolte | C11D 3/044 264/71 |
| 2009/0156454 | A1 | 6/2009 | Schmiedel et al. | |
| 2009/0186795 | A1 | 7/2009 | Feenstra et al. | |
| 2010/0197545 | A1 | 8/2010 | Silvernail et al. | |
| 2010/0298192 | A1 | 11/2010 | Feenstra et al. | |
| 2010/0298193 | A1 * | 11/2010 | Tjelta | C11D 1/83 510/224 |
| 2011/0053821 | A1 | 3/2011 | Silvernail et al. | |
| 2011/0071065 | A1 | 3/2011 | Silvernail et al. | |
| 2011/0180112 | A1 | 7/2011 | Silvernail et al. | |
| 2012/0053104 | A1 | 3/2012 | Olson et al. | |

FOREIGN PATENT DOCUMENTS

| | | |
|---|---|---|
| EP | 1953217 A1 | 8/2008 |
| EP | 1953217 B1 | 8/2009 |
| WO | 1998047994 | 10/1998 |

OTHER PUBLICATIONS

Peschard, A. et al., "Effect of polysaccharides on the hydration of cement paste at early stages" 44 pages, Jan. 30, 2007.

* cited by examiner

*Primary Examiner* — Lorna M Douyon

(74) *Attorney, Agent, or Firm* — McKee, Voorhees & Sease, PLC

(57) ABSTRACT

Solid detergent compositions according to the present invention include at least one alkali metal silicate, at least one polycarboxylic acid, at least one saccharide or sugar alcohol and water. Suitable saccharides include sucrose, fructose, inulin, maltose and lactulose, and may be present in the composition in a concentration of at least 0.5 wt %. Compositions according to certain embodiments form stable solid block detergent compositions that do not swell significantly even when subjected to elevated temperatures.

11 Claims, 6 Drawing Sheets

DETERGENT COMPOSITION INCLUDING A SACCHARIDE OR SUGAR ALCOHOL

CROSS-REFERENCE TO RELATED APPLICATIONS

This is a Continuation Application of U.S. Ser. No. 14/340,127 filed Jul. 24, 2014, now U.S. Pat. No. 9,598,660, which is a Continuation Application of U.S. Ser. No. 13/268,488 filed Oct. 7, 2011, now U.S. Pat. No. 8,822,403, issued Sep. 2, 2014, which claims the benefit under 35 U.S.C. § 119(e) to U.S. Provisional Patent Application No. 61/434,668, filed on Jan. 20, 2011, entitled "Detergent Composition including a Saccharide," all of which are incorporated herein by reference in their entirety.

BACKGROUND

The present invention relates generally to the field of solid detergent compositions. In particular, the present invention relates to solid detergent compositions containing saccharides and/or sugar alcohols.

The advent of solid block detergent compositions containing alkali cleaning agents has revolutionized the manner in which detergents are dispensed by commercial and institutional entities which routinely use large quantities of cleaning solution. The solid block compositions are generally formed by combining the alkali cleaning agent with one or more solidification components in a liquid solution. The solidification components interact with the alkali cleaning agent and cause the composition to form a solid block with minimal if any energy input.

One challenge that arises when transporting and subsequently using such solid block compositions is that swelling can occur particularly when the solid block composition is subjected to higher temperature conditions. The result is that the block composition may break apart, damage the packaging in which it is stored and/or not fit properly into dispensing machines. Various materials have been added to solid block compositions to control swelling. However, increased regulation of detergent compositions has created a need to identify compounds that help control swelling while also having a low impact on the environment.

SUMMARY

One embodiment is a solid detergent composition including at least one alkali metal silicate, at least one saccharide or sugar alcohol and water. Suitable saccharides include mono-, di- and polysaccharides containing 3 or more saccharide units. Sucrose, fructose, inulin, lactulose, maltose and combinations thereof, may be particularly suitable.

Another embodiment is a solid detergent composition including from about 0.1 wt % to about 70 wt % of at least one alkali metal silicate, from about 0.5 wt % to about 10 wt % of at least one saccharide or sugar alcohol, and from about 10 wt % to about 70 wt % water. A further embodiment is a method of forming a solid detergent composition in which at least one alkali metal silicate, at least one saccharide or sugar alcohol and water are combined to form a mixture, and a solid detergent composition is then formed from the mixture.

DETAILED DESCRIPTION

Figure 1:
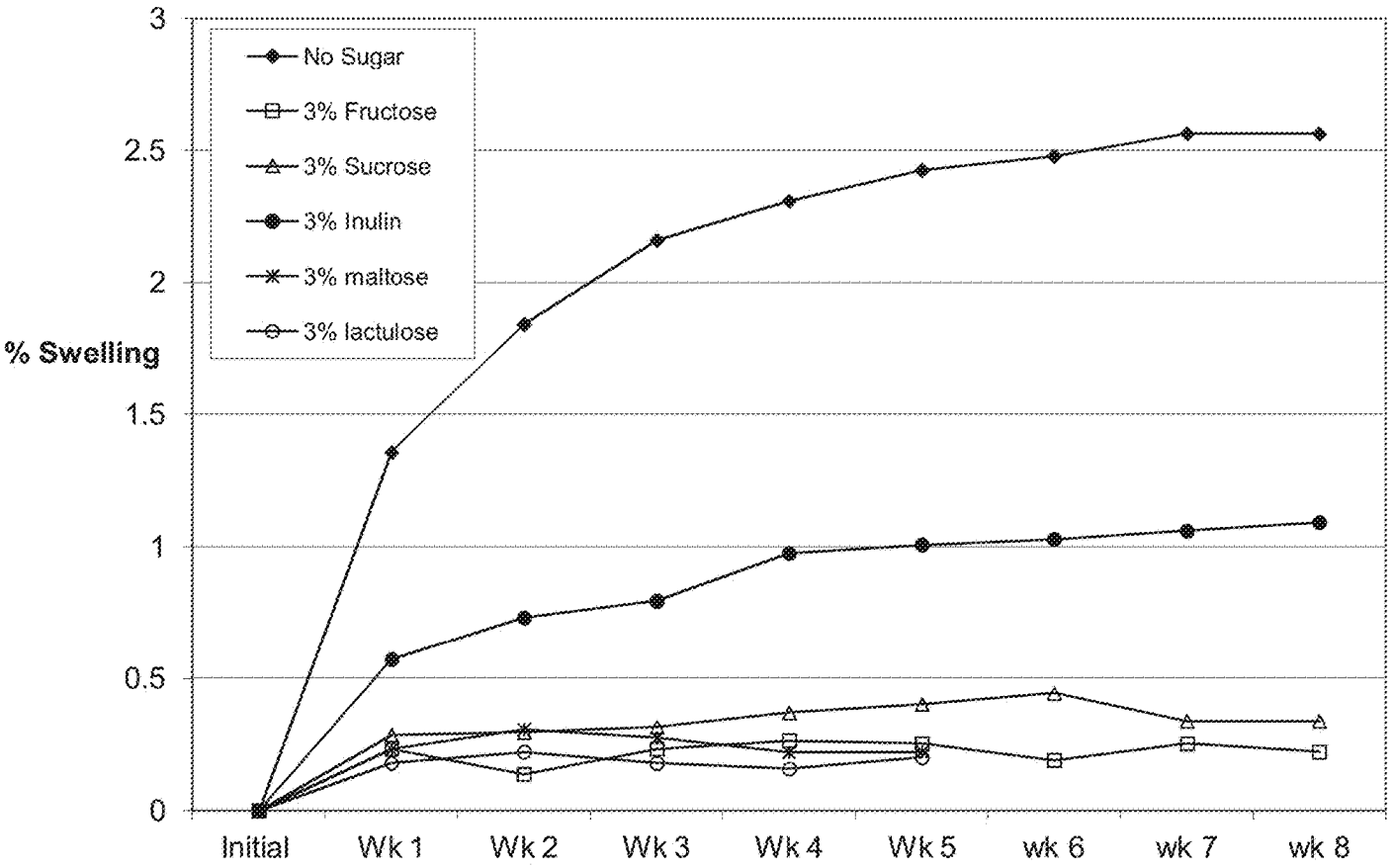
FIG. 1 is a line graph illustrating percent swelling of embodiments of the invention set forth in the Examples.

Embodiments of the present invention provide solid, dimensionally stable, compositions including at least one alkali metal silicate cleaning agent, water and at least one saccharide or sugar alcohol. Such compositions may be particularly useful in cleaning applications where it is desired to use a phosphate-free detergent. Such applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, industrial or household cleaners, and pest control agents.

The solid detergent composition includes an effective amount of alkali metal silicate sources to enhance cleaning of the desired substrate and improve soil removal performance of the solid composition. The composition may include the alkali metal silicate in an amount of between about 0.1% by weight and 80% by weight, more particularly, between about 10% by weight and about 60% by weight, and even more particularly, between about 25% by weight and about 60% by weight.

An effective amount of one or more alkali metal silicate sources may provide a use composition (i.e., an aqueous solution containing the composition) having a pH of at least about 8. When the use composition has a pH of between about 8 and about 10, it can be considered mildly alkali, and when the pH is greater than about 12, the use composition can be considered caustic.

Examples of suitable alkali metal silicates include lithium, sodium and potassium silicate or metasilicate, as well as combinations of the foregoing materials. The alkali metal silicate may be used to form the composition without modification or may be combined with other raw materials such as alkali metal hydroxide to form alkali metal metasilicate prior to or in the process of making the solid composition. Commercial sodium silicates are available in both powdered and liquid forms. The powdered forms include both amorphous and crystalline powders in either hydrated or anhydrous form. The aqueous liquids are available with viscosities ranging from 0.5 to 600,000 centipoise at 20° C. Potassium silicates are sold either as a glass or an aqueous liquid. The synthetic lithium silicates typically are generally sold only as liquids.

The more common commercially available sodium silicates vary in $Na_2O/SiO_2$ ratio from about 2:1 to about 1:4.

The solid forms of alkali metal silicates are generally classified by particle-size range and $Na_2O/SiO_2$ ratio. The aqueous solutions are identified by any combination of density/specific gravity, alkali:silica ratio, and viscosity. Typically, the aqueous solutions are differentiated on the basis of specific gravity and $Na_2O/SiO_2$ ratio. Concentrated solutions of highly alkali sodium silicates are quite sticky or tacky. Conversely, concentrated solutions of highly siliceous sodium silicate show little tack but are plastic enough to form into balls which show a surprising elasticity.

The crystalline products which are readily available on a commercial scale are the anhydrous and hydrated sodium metasilicates ($Na_2SiO_3$, $Na_2SiO_3$; $5H_2O$ and $SiO_3$ $9H_2O$) and the hydrated sodium sesquisilicates ($Na_2HSiO_4$ $5H_2O$ and $3Na_2O_2.SiO_2$ $11H_2O$). The anhydrous sodium sesquisilicate and the technically anhydrous orthosilicates are also available but generally mixtures of caustic soda and sodium metasilicate.

The liquid products which are readily available on a commercial scale include $M_2O:SiO_2$ ratios from about 1:1.5 to 1:3.8 for sodium silicate and about 1:1.5 to about 1:2.5 for potassium silicate with a water content from about 45 to about 75 wt % based upon the weight of the silicate and the water.

A listing of commercially available alkali metal silicates are provided in Tables 1-2 below. The physical properties of various crystalline alkali silicates are provided in Table 3 below.

TABLE 2

| Name | ($M_2O:SiO_2$) (wt) | % $M_2O$ | % $SiO_2$ | Baume at 20° C. | Specific Gravity | Viscosity (Poise/ 20° C.) |
|---|---|---|---|---|---|---|
| Sodium | 1:160 | 19.70 | 31.5 | 58.3 | 1.68 | 70.00 |
| Silicate | 1:2.00 | 18.00 | 36.0 | 59.3 | 1.69 | 700.00 |
| (solutions) | 1:2.50 | 10.60 | 26.5 | 42.0 | 1.41 | 0.60 |
| | 1:2.88 | 11.00 | 31.7 | 47.0 | 1.49 | 9.60 |
| | 1:3.22 | 8.90 | 28.7 | 41.0 | 1.39 | 1.80 |
| | 1:3.75 | 6.80 | 25.3 | 35.0 | 1.32 | 2.20 |
| Potassium | 1:2.50 | 8.30 | 20.8 | 29.8 | 1.26 | 0.40 |
| Silicate | 1:2.20 | 9.05 | 19.9 | 30.0 | 1.26 | 0.07 |
| (solutions) | 1:2.10 | 12.50 | 26.3 | 40.0 | 1.38 | 10.50 |
| | 1:1.80 | 10.40 | 29.5 | 47.7 | 1.49 | 13.00 |
| Lithium | 1:9.4 | 2.20 | 20.7 | — | — | — |
| Silicate | 1:9.6 | 2.10 | 20.0 | — | — | 4.00 |
| (solutions) | 1:11.8 | 1.60 | 18.8 | — | — | — |
| | 1:17.0 | 1.20 | 20.0 | — | — | 2.50 |

TABLE 3

| Name | Formula | Melting Point (° C.) | Density (g/ml) | ΔH cal/wt at 25° | RI alpha | RI beta | RI gamma |
|---|---|---|---|---|---|---|---|
| Sodium Orthosilicate | $Na_4SiO_4$ ($2Na_2O•SiO_2$) | 1118 | 2.50 | −497,800 | 1.524 | — | 1.537 |
| Sodium Sesquisilicate | $Na_6Si_2O_7$ ($3Na_2O•2SiO_2$) | 1122 | 2.96 | −856,300 | 1.524 | — | 1.529 |
| Sodium Sesquisilicate Pentahydrate | $Na_6Si_2O_75H_2O$ ($3Na_2O•2SiO_25H_2O$) | 88 | — | −1,648,000 | 1.502 | 1.510 | 1.524 |
| Sodium Metasilicate | $Na_2SiO_3$ ($Na_2O•SiO2$) | 1089 | 2,614 | −364,700 | 1,490 | 1.500 | 1.510 |
| Sodium Metasilicate Pentahydrate | $Na_2SiO_35H_2O$ ($Na_2O•Si_2O_25H_2O$) | 72.2 | 1.749 | −722,100 | 1.447 | 1.454 | 1.467 |
| Sodium Metasilicate hexahydrate | $Na_2SiO_36H_2O$ ($Na_2O•SiO_36H_2O$) | 70<br>62.9 | 1.807 | −792,600 | 1488<br>1.465 | —<br>1.475 | 1.495<br>1.465 |
| Sodium Metasilicate Octahydrate | $Na_2SiO_38H_2O$ ($Na_2O•SiO_38H_2O$) | 48.35 | 1.672 | −934,800 | 1.475 | 1.463 | 1.465 |
| Sodiuin Metasilicate Nanohydrate | $Na_2SiO_39H_2O$ ($Na_2O•SiO_29H_2O$) | 47.85 | 1.646 | −1,005,100 | 1.451 | 1.456 | 1.460 |
| Sodiuin | $Na_2Si_2O_5$ | 874 | 2.964 | −576,100 | 1.500 | 1.510 | 1.518 |

TABLE 1

Commercial Solid Silicates

| Name | $M_2O:SiO_2$ (wt) | % $M_2O$ | % $SiO_2$ | % $H_2O$ | Softening Pt (° C.) | Flow Pt (° C.) |
|---|---|---|---|---|---|---|
| Sodium | 1:3.22 | 23.5 | 75.7 | — | 655 | 840 |
| Silicate (anhydrous glasses) | 1:2.00 | 33.0 | 66.0 | — | 590 | 760 |
| Potassium Silicate (anhydrous glasses) | 1:2.50 | 28.3 | 70.7 | — | 700 | 905 |
| Sodium | 1:3.22 | 19.2 | 61.8 | 18.5 | — | — |
| Silicates (hydrated amphorous powders) | 1:2.00 | 27.0 | 54.0 | 18.5 | — | — |

The solid composition may include between about 0.1% by weight and about 25% by weight saccharide or sugar alcohol, more particularly, between about 1.0% by weight and about 15% by weight saccharide or sugar alcohol, even more particularly, between about 1.0% by weight and about 10% by weight saccharide or sugar alcohol, and even more particularly from about 1.0% by weight to about 7.0% by weight saccharide or sugar alcohol.

Suitable saccharides for use with embodiments of the present invention include monosaccharides, disaccharides and polysaccharides, and in particular mono-, di- and polysaccharides containing 3 or more saccharide units. Suitable saccharides can have a cyclic or non-cyclic structure. Exemplary saccharides include, but are not limited to glucose, fructose, lactulose galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose, theose, amylose, amylopectin, pectin, inulin, modified inulin, potato starch, modified potato starch, corn starch, modified corn starch, wheat starch, modified wheat starch, rice starch, modified rice starch, cellulose, modified cellulose, dextrin, dextran, maltodextrin, cyclodextrin, glycogen and oligiofructose, sodium carboxymethylcellulose, linear sulfonated α-(1,4)-linked D-glucose polymers, γ-cyclodextrin and the like. Sugar alcohols may also be suitable. Examples of particularly suitable saccharide based sugars include, but are not limited to sucrose, fructose, inulin, lactulose, maltose and combinations thereof.

Examples of suitable inulin saccharides include, but are not limited to, naturally-occurring and derivatized inulins. Derivatized inulins are modified to be further substituted at a varying number of the available hydroxyls, with alkyl, alkoxy, carboxy, and carboxyalkyl moieties, for example. Examples of particularly suitable commercially available carboxymethyl inulin-based polymers include, but are not limited to: Dequest PB 11615, Dequest PB 11620 and Dequest PB 11625, available from Solutia, Inc., St. Louis, Mo. DEQUEST PB 11625 is a 20% solution of carboxymethyl inulin, sodium salt, having a MW>2000.

As discussed above, sugar alcohols may also be suitable. Examples of suitable sugar alcohols include, but are not limited to, glycol, glycerol, erythritol, threitol, arabitol, xylitol, ribitol, mannitol, sorbitol, dulcitol, iditol, isomalt, malitol, polyglycitol, lactitol, and other polyols. Examples of particularly suitable sugar alcohols include but are not limited to sorbitol.

Water may be independently added to the composition or may be provided in the composition as a result of its presence in an aqueous material that is added to the detergent composition. For example, materials added to the detergent composition may include water or may be prepared in an aqueous premix. Typically, water is introduced into the composition to provide a desired viscosity for processing prior to solidification and to provide a desired rate of solidification. The water may also be present as a processing aid and may be removed or become water of hydration. The water may also be provided as deionized water or as softened water.

The amount of water in the resulting solid detergent composition will depend on whether the solid detergent composition is processed through forming techniques or casting (solidification occurring within a container) techniques. In general, when the components are processed by forming techniques, the solid detergent composition may include a smaller amount of water for solidification compared with the casting techniques. When preparing the solid detergent composition by casting techniques, water may be present in ranges of between about 5% and about 50% by weight, particularly between about 10% and about 40% by weight, and more particularly between about 20% and about 40% by weight.

The composition may optionally include at least about 0.5% by weight of polycarboxylic acid polymer, copolymers and/or salts thereof, more particularly, from about 1% by weight to about 25% by weight, even more particularly, from about 3% by weight to about 15% by weight. Examples of suitable polycarboxylic acid polymer include, but are not limited to: polyacrylic acid polymers, polyacrylic acid polymers modified by a fatty acid end group ("modified polyacrylic acid polymers"), and polymaleic acid polymers. Examples of particularly suitable polyacrylic acid polymers and modified polyacrylic acid polymers include those having a molecular weight of between about 1,000 g/mol and about 100,000 g/mol. Examples of more particularly suitable polymaleic acid polymers include those having a molecular weight of between about 500 g/mol and about 5,000 g/mol.

An example of particularly suitable commercially available polyacrylic acid polymer includes, but is not limited to, Acusol 445N, available from Rohm & Haas LLC, Philadelphia, Pa. An example of particularly suitable commercially available modified polyacrylic acid polymer includes, but is not limited to, Alcosperse 325, available from Alco Chemical, Chattanooga, Tenn. Examples of particularly suitable commercially available polymaleic acid polymers include, but are not limited to: Belclene 200, available from Houghton Chemical Corporation, Boston, Mass. and Aquatreat AR-801, available from Alco Chemical, Chattanooga, Tenn.

In one embodiment, at least two polycarboxylic acid polymers are used. For example, the combination of at least one polyacrylic acid and at least one polymaleic acid may be used to provide the composition with suitable solidification properties. The polycarboxylic acid combinations may further function as a corrosion inhibitor.

The solid detergent composition may be phosphorus-free and/or nitrilotriacetic acid (NTA)-free to make the solid detergent composition more environmentally beneficial. Phosphorus-free means a composition having less than approximately 0.5 wt %, more particularly, less than approximately 0.1 wt %, and even more particularly less than approximately 0.01 wt % phosphorous based on the total weight of the composition. NTA-free means a composition having less than approximately 0.5 wt %, less than approximately 0.1 wt %, and particularly less than approximately 0.01 wt % NTA based on the total weight of the composition. When the composition is NTA-free, it is also compatible with chlorine, which functions as an anti-redeposition and stain-removal agent.

If the solid detergent composition swells after solidification, various problems may occur, including but not limited to: decreased density, integrity, appearance, and inability to dispense or package the solid product. Generally, a solid product is considered to have dimensional stability if the solid product has a growth exponent (i.e., percent swelling) of less than about 3% and particularly less than about 2%. Growth exponent refers to the percent growth of a product over a period of time after solidification under normal transport/storage conditions. Because normal transport/storage conditions for detergent products may result in the solid detergent composition being subjected to an elevated temperature, the growth exponent may be determined by measuring one or more dimensions of the solid product prior to and after heating to between 100° F. and 120° F. for several hours, days or even weeks. The measured dimension depends on the shape of the solid detergent composition. For tablet shaped compositions, both diameter and height are generally measured. For capsule shaped compositions, only diameter is generally measured.

Embodiments of the present invention including a saccharide or sugar alcohol may have a growth exponent that is less than the growth exponent of the same composition without a saccharide or sugar alcohol. More particularly, of the present invention including a saccharide or sugar alcohol may have a growth exponent that is less than about 3%, more particularly, less than about 2% when subjected to elevated temperatures of at least about 100° F., more particularly, about 120° F. More particularly, the growth exponent may remain below 2% even after heating at 120° F. for at least about three weeks.

Additional Functional Materials

The components of the detergent composition can be combined with various functional components. In some embodiments, the alkali metal silicate, saccharide or sugar alcohol and water make up a large amount, or even substantially all of the total weight of the detergent composition, for example, in embodiments having few or no additional functional materials disposed therein. In these embodiments, the component concentration ranges provided above for the detergent are representative of the ranges of those same components in the detergent composition. In other embodiments, the detergent composition consists essentially of the alkali metal silicate, at least one saccharide or sugar alcohol, water, at least one polycarboxylic acid, optionally sodium carbonate, optionally at least one secondary alkali source and optionally at least one surfactant.

The functional materials provide desired properties and functionalities to the solid detergent composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multi-functional and may also provide several of the functional benefits discussed below.

Secondary Alkali Source

The solid detergent composition can include one or more secondary alkali sources. Examples of suitable secondary alkali sources of the solid detergent composition include, but are not limited to alkali metal carbonates and alkali metal hydroxides. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to: sodium or potassium hydroxide. The alkali metal hydroxide may be added to the composition in any form known in the art, including as solid beads, dissolved in an aqueous solution, or a combination thereof. In some embodiments, the detergent composition does not include a secondary detergent source such as sodium carbonate. If included, the secondary alkali source, for example sodium carbonate, may be present in concentration of from 15-40 wt %. An exemplary detergent composition including carbonate may have the following component and component concentrations:

TABLE 4

| Material | First Exemplary Wt % Range | Second Exemplary Wt % Range |
|---|---|---|
| Water | 10-70 | 10-30 |
| Sodium Metasilicate | 0.1-70 | 25-50 |
| polycarboxylic acid polymer(s) | 1-15 | 5-15 |
| Sodium Carbonate | 15-40 | 15-40 |
| Surfactant | 0.05-20 | 0.1-5 |
| Saccharide or sugar alcohol | 0.1-25 | 0.1-7 |

Surfactants

The solid detergent composition can include at least one cleaning agent comprising a surfactant or surfactant system. A variety of surfactants can be used in a solid detergent composition, including, but not limited to: anionic, nonionic, cationic, and zwitterionic surfactants. Surfactants are an optional component of the solid detergent composition and can be excluded from the concentrate. Exemplary surfactants that can be used are commercially available from a number of sources. For a discussion of surfactants, see Kirk-Othmer, Encyclopedia of Chemical Technology, Third Edition, volume 8, pages 900-912. When the solid detergent composition includes a surfactant as a cleaning agent, the cleaning agent is provided in an amount effective to provide a desired level of cleaning. The solid detergent composition, when provided as a concentrate, can include the surfactant cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the solid detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the solid detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va.

Examples of cationic surfactants that can be used in the solid detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the solid detergent composition include, but are not limited to: betaines, imidazolines, and propionates.

Because the solid detergent composition is intended to be used in an automatic dishwashing or warewashing machine, the surfactants selected, if any surfactant is used, can be those that provide an acceptable level of foaming when used inside a dishwashing or warewashing machine. Solid detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Builders or Water Conditioners

The solid detergent composition can include one or more building agents, also called chelating or sequestering agents (e.g., builders), including, but not limited to: condensed phosphates, alkali metal carbonates, phosphonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the solid detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the solid detergent composition by fixing the free water present in the composition as water of hydration.

Examples of phosphonates included, but are not limited to: 2-phosphonobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2 PO(OH)_2]_3$; aminotri(methylenephosphonate), sodium salt (ATMP), $N[CH_2 PO(ONa)_2]_3$; 2-hydroxyethyliminobis (methylenephosphonic acid), $HOCH_2CH_2 N[CH_2PO(OH)_2]2$; diethylenetriaminepenta(methylenephosphonic acid), $(HO)_2POCH_2 N[CH_2 N[CH_2 PO(OH)_2]_2]_2$; diethylenetriaminepenta(methylenephosphonate), sodium salt (DTPMP), $C_9 H_{(28-x)} N_3 Na_x O_{15} P_5$ (x=7); hexamethylenediamine(tetramethylenephosphonate), potassium salt, $C_{10}H_{(28-x)} N_2K_x O_{12} P_4$ (x=6); bis(hexamethylene)triamine(pentamethylenephosphonic acid), $(HO_2)POCH_2N[CH_2)_2N[CH_2 PO(OH)_2]_2]_2$; and phosphorus acid, $H_3PO_3$. A preferred phosphonate combination is ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the detergent composition if free of phosphorous.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition if free of aminocarboxylates.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. Other suitable water conditioning polymers include starch, sugar or polyols comprising carboxylic acid or ester functional groups. Exemplary carboxylic acids include but are not limited to maleic, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers Hardening Agents The solid detergent compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid detergent composition during use.

The amount of hardening agent included in the solid detergent composition will vary according to factors including, but not limited to: the type of solid detergent composition being prepared, the ingredients of the solid detergent composition, the intended use of the composition, the quantity of dispensing solution applied to the solid composition over time during use, the temperature of the dispensing solution, the hardness of the dispensing solution, the physical size of the solid detergent composition, the concentration of the other ingredients, and the concentration of the cleaning agent in the composition. It is preferred that the amount of the hardening agent included in the solid detergent composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the solid detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of solid detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight. In one embodiment, however, the solid composition if free of sulfates and carbonates including soda ash.

Urea particles can also be employed as hardeners in the solid detergent compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid detergent composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the solid detergent composition for lightening or whitening a substrate include bleaching compounds capable of liberating an active halogen species, such as $Cl_2$, $Br_2$, $-OCl^-$ and/or $-OBr^-$, under conditions typically encountered during the cleansing process. Suitable bleaching agents for use in the solid detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight.

Fillers

The solid detergent composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the warewashing composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposition Agents

The solid detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight.

Stabilizing Agents

The solid detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

Dispersants

The solid detergent composition may also include dispersants. Examples of suitable dispersants that can be used in the solid detergent composition include, but are not limited to: maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in the solid detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the solid detergent composition is provided as a use composition. Exemplary ranges of the enzyme in the concentrate include up to approximately 15% by weight, between approximately 0.5% to approximately 10% by weight, and between approximately 1% to approximately 5% by weight.

Glass and Metal Corrosion Inhibitors

The solid detergent composition can include a metal corrosion inhibitor in an amount up to approximately 50% by weight, between approximately 1% and approximately 40% by weight, or between approximately 3% and approximately 30% by weight. The corrosion inhibitor is included in the solid detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the solid detergent composition. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkali metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

The applicants discovered that by controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be between at least approximately 6:1, can be less than approximately 1:20, and can be between approximately 2:1 and approximately 1:15.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as CIS jasmine or jasmal, and vanillin.

Thickeners

The solid detergent compositions can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the solid detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas campestras*. Xanthan may be made by fermentation based on corn sugar or other corn sweetener by-products. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use solution that can produce large particle size mist or aerosol when sprayed.

Methods of Manufacture

In general, a solid detergent composition of the present invention can be created by combining the alkali metal silicate, polycarboxylate polymer, saccharide or sugar alcohol, water, and any additional functional components and allowing the components to interact and solidify.

The alkali metal silicate, and additional functional components harden into solid form due to the chemical reaction of the metal silicate with the water. The solidification process may last from a few minutes to about six hours, depending on factors including, but not limited to: the size of the formed or cast composition, the ingredients of the composition, and the temperature of the composition.

The solid detergent compositions may be formed using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly up to approximately 120° F.

The resulting solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the composition have a weight of approximately 100 grams or greater, and solid block detergents formed by the composition have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams.

In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Although the detergent composition is discussed as being formed into a solid product, the detergent composition may also be provided in the form of a paste. When the concentrate is provided in the form of a paste, enough water is added to the detergent composition such that complete solidification of the detergent composition is precluded. In addition, dispersants and other components may be incorporated into the detergent composition in order to maintain a desired distribution of components.

Method of Using

The detergent composition is a concentrate solid which can be diluted with water, known as dilution water, to form a concentrate solution or a use solution. In general, a concentrate refers to a composition that is intended to be diluted with water to provide a use solution; a use solution is dispersed or used without further dilution. The use solution can be used to clean substrates such as during warewashing.

In one example, the solid detergent composition is diluted such that the use solution has sufficient detersivity. The typical dilution factor is between approximately 1 and approximately 10,000 but will depend on factors including water hardness, the amount of soil to be removed and the like. In one embodiment, the solid detergent composition is diluted at a ratio of between about 1:10 and about 1:1000 concentrate to water. Particularly, the solid detergent composition is diluted at a ratio of between about 1:100 and about 1:5000 concentrate to water. More particularly, the solid detergent composition is diluted at a ratio of between about 1:250 and 1:2000 concentrate to water.

Suitable concentration ranges for the use solution include between about 10 ppm and about 1000 ppm of at least one alkali metal silicate, between about 5 ppm and about 200 ppm of at least one saccharide or sugar alcohol, and between about 10% and about 70% by weight water. When a polysaccharide is present, a suitable concentration range for at least one polysaccharide is between about 10 ppm and about 200 ppm. When sodium carbonate is present, a suitable concentration range for sodium carbonate is between about 1 ppm and about 1000 ppm.

The solid detergent concentrate can contain an effective concentration of the at least one alkali metal silicate and optionally sodium carbonate so that use composition has a pH of at least about 9.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

Acusol 445ND: a polyacrylic acid, 97% active, available from Dow

Belclene 200: a 400-800 MW polymaleic acid, 50% active, available from Houghton Chemical Corporation Sucrose: α-D-glucopyranosyl (1→2) β-D-fructofuranoside (chemical name)

Fructose: levulose, $C_6H_{12}O_6$

Inulin: $C_{6n}H_{10n+2}O_{5n+1}$

Maltose: Isomaltase, 4-O-α-D-Glucopyranosyl-D-glucose

Lactulose: 4-O-β-D-Galactopyranosyl-β-D-fructofuranose

Pluronic N3: an ethylene oxide/propylene oxide block copolymer available from BASF Corporation, Florham Park, N.J.

Sorbitol: D-glucitol

EXAMPLES 1-6

The raw materials identified for each of Examples 1-6 in Table 5 below were combined and mixed. Example 1 was a control containing no saccharide. Each of the remaining Examples 2-6 included equal weight percentages of the identified saccharide.

TABLE 5

| Description | Control | EX #2 | EX #3 | EX #4 | EX #5 | EX #6 |
|---|---|---|---|---|---|---|
| Water | 33 | 31.7 | 31.7 | 31.7 | 31.7 | 31.7 |
| Sodium Metasilicate Anhydrous | 49 | 47.5 | 47.5 | 47.5 | 47.5 | 47.5 |
| Acusol 445ND (97% active) | 7 | 6.9 | 6.9 | 6.9 | 6.9 | 6.9 |
| Belclene 200 (50% active) | 6 | 5.9 | 5.9 | 5.9 | 5.9 | 5.9 |
| Sodium Metasilicate Pentahydrate | 4 | 4 | 4 | 4 | 4 | 4 |
| Pluronic N3 | 1 | 1 | 1 | 1 | 1 | 1 |
| Fructose (monosaccharide) | 0 | 3 | 0 | 0 | 0 | 0 |
| Sucrose (disaccharide) | 0 | 0 | 3 | 0 | 0 | 0 |
| Inulin (polysaccharide) | 0 | 0 | 0 | 3 | 0 | 0 |
| maltose | 0 | 0 | 0 | 0 | 3 | 0 |
| Lactulose | 0 | 0 | 0 | 0 | 0 | 3 |
| Total Wt % | 100 | 100 | 100 | 100 | 100 | 100 |

Once thoroughly mixed, each example was then poured into a 16 oz cylindrical high density polyethylene container with a line drawn around the circumference of the container about 1.75 inches from the container bottom. The mixtures were allowed to harden into capsules in the container. Once hardened, three diameter measurements were taken via caliper for each of the six containers corresponding to Experiments 1-6 and then separately averaged to determine an initial capsule diameter.

Figure 2:
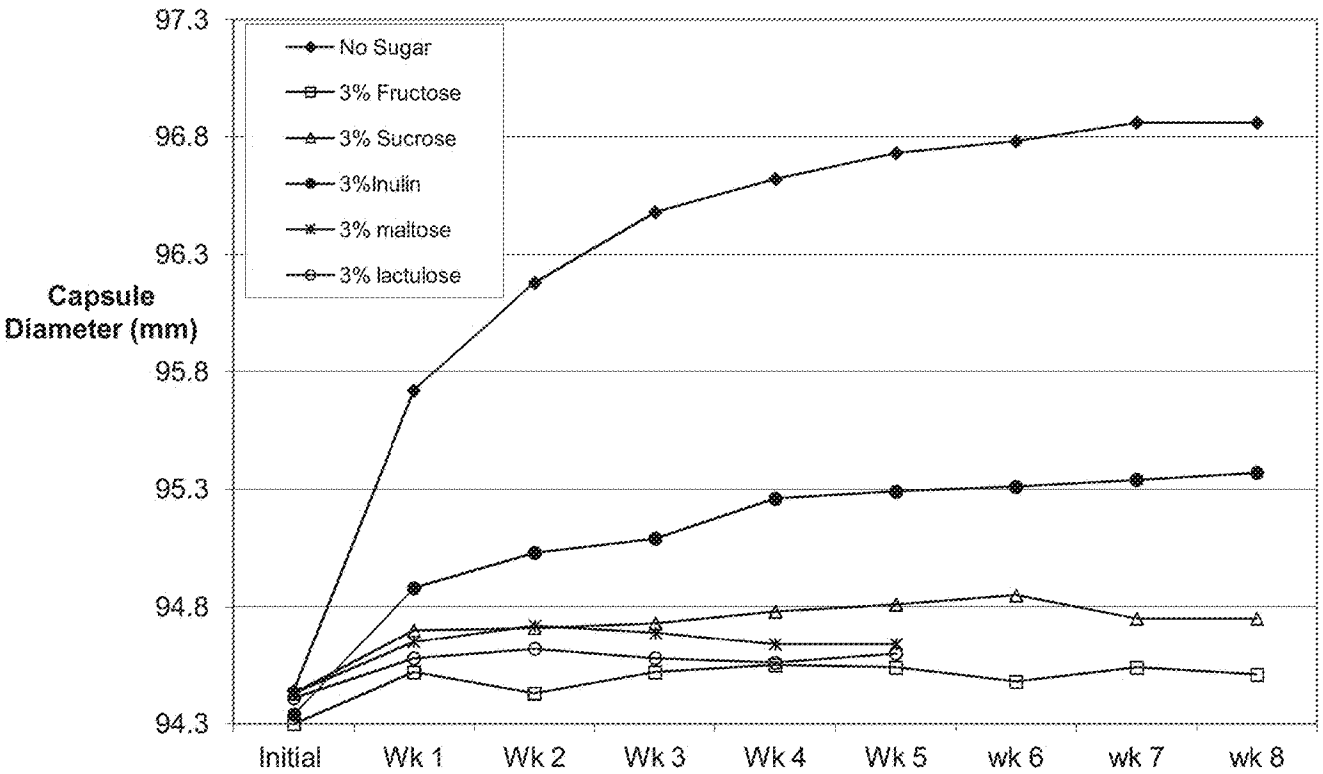
FIG. 2 is a line graph illustrating capsule growth of embodiments of the invention set forth in the Examples

The containers were then placed in an oven at 122° F. for 5 weeks with additional diameter measurements taken once a week to determine the average increase in swelling capsule growth of each Example. FIGS. 1 and 2 are line graphs showing the results, which indicate that Examples 2-6 containing equal weight percentages of various saccharides exhibited reduced swelling and diameter increase compared to the control, which included no saccharide. In particular, Examples 2-6 experienced less than two percent swelling over the five week test period.

EXAMPLES 7-10

Examples 7-10 set forth in Table 6 below were prepared in the same manner as Examples 1-6 except that equal mole amounts of the saccharides were used.

TABLE 6

| Description | EX #7 | EX #8 | EX #9 | EX #10 |
|---|---|---|---|---|
| Water | 32.4 | 32.1 | 32.1 | 32.1 |
| Sodium Metasilicate Anhydrous | 48.4 | 48 | 48 | 48 |
| Acusol 445ND (97% active) | 7.1 | 7 | 7 | 7 |
| Belclene 200 | 6.1 | 6 | 6 | 6 |

TABLE 6-continued

| Description | EX #7 | EX #8 | EX #9 | EX #10 |
|---|---|---|---|---|
| (50% active) | | | | |
| Sodium Metasilicate Pentahydrate | 4 | 4 | 4 | 4 |
| Pluronic N3 | 1 | 1 | 1 | 1 |
| Fructose (monosaccharide) | 1 | 0 | 0 | 0 |
| Sucrose (disaccharide) | 0 | 1.9 | 0 | 0 |
| maltose | 0 | 0 | 1.9 | 0 |
| Lactulose | 0 | 0 | 0 | 1.9 |
| Total Mole % | 100 | 100 | 100 | 100 |
| MOLES OF SACCHARIDE ADDED | 5.6 milimoles | 5.6 milimoles | 5.6 milimoles | 5.6 milimoles |

Figure 3:
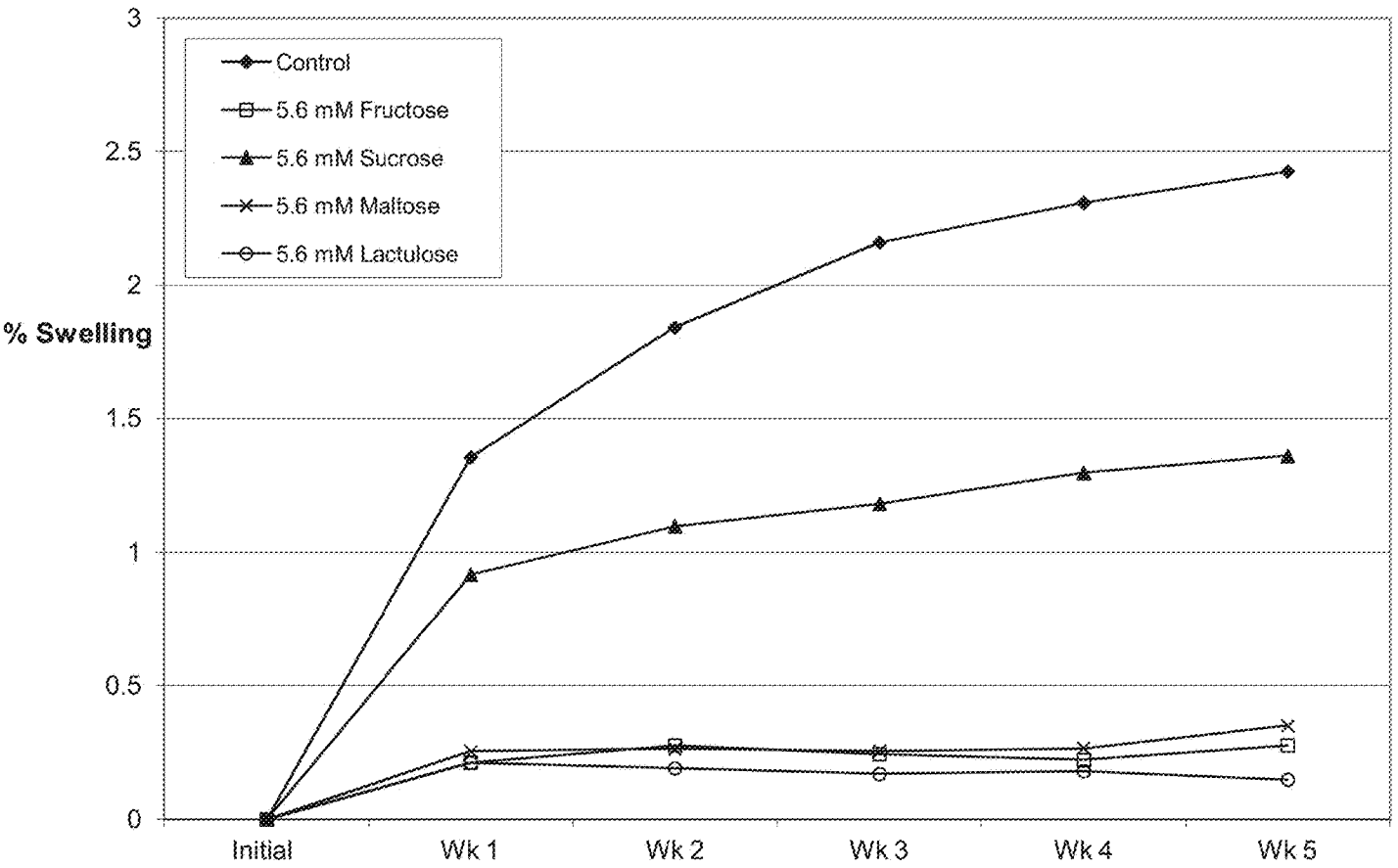
FIG. 3 is a line graph illustrating percent swelling of embodiments of the invention set forth in the Examples.
Figure 4:
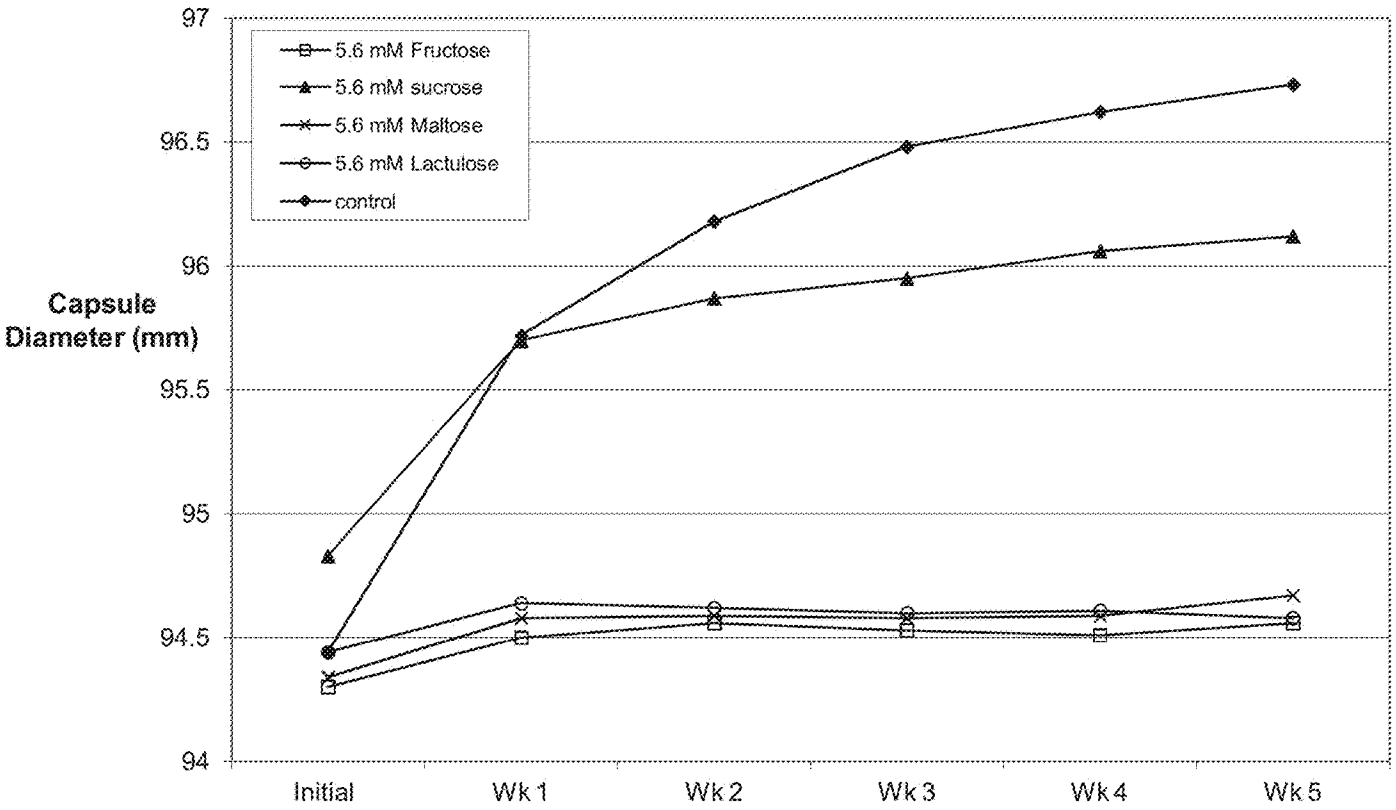
FIG. 4 is a line graph illustrating capsule growth of embodiments of the invention set forth in the Examples.

The containers containing the capsules were then heated and measured as described with respect to Example 1-6. FIGS. 3 and 4 are line graphs showing the results, which indicate that Examples 7-10 containing equal mole amounts of various saccharides exhibited reduced diameter increase and swelling compared to control Example 1, which included no saccharide. In particular, Examples 7-10 experienced less than two percent swelling over the five week test period.

EXAMPLES 11-13

Examples 11-13 set forth in Table 7 below were prepared in the same manner as Examples 1-6 except Examples 11-13 also included sodium carbonate. Example 11 was a control which did not contain a saccharide, and Example 12 included a saccharide, and Example 13 contained a sugar alcohol.

TABLE 7

| Description | EX #11 | EX #12 | EX #13 |
|---|---|---|---|
| Water | 29.9 | 29.9 | 29.9 |
| Sodium Metasilicate Anhydrous | 36 | 36 | 36 |
| Ash monohydrate | 24.6 | 24.6 | 24.6 |
| Acusol 445ND (97% active) | 4.5 | 4.5 | 4.5 |
| Belclene 200 (50% active) | 3.5 | 3.5 | 3.5 |
| Sodium Metasilicate Pentahydrate | 4 | 4 | 4 |
| Pluronic N3 | 1 | 1 | 1 |
| Sucrose (disaccharide) | 0 | 2 | 0 |
| Sorbitol (sugar alcohol) | 0 | 0 | 2 |
| Total Wt % | 103.5 | 105.5 | 105.5 |

Figure 5:
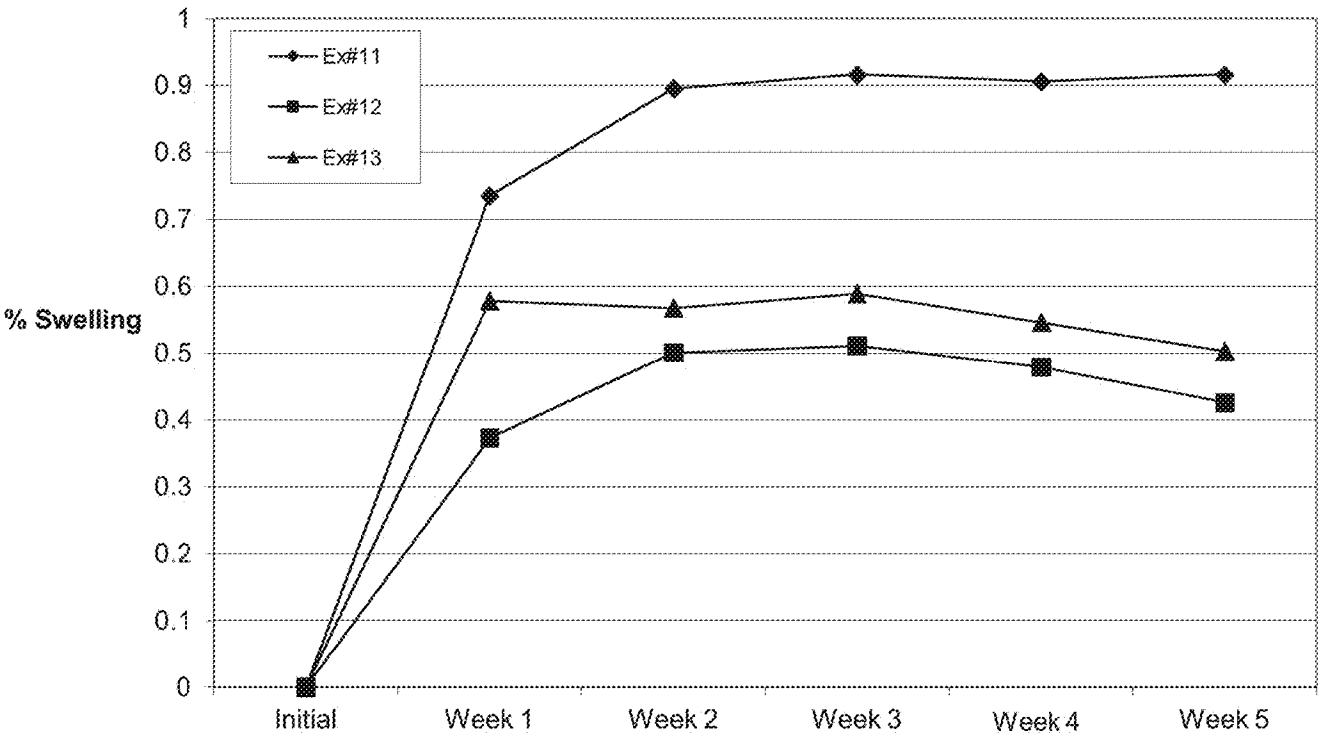
FIG. 5 is a line graph illustrating percent swelling of embodiments of the invention set forth in the Examples.
Figure 6:
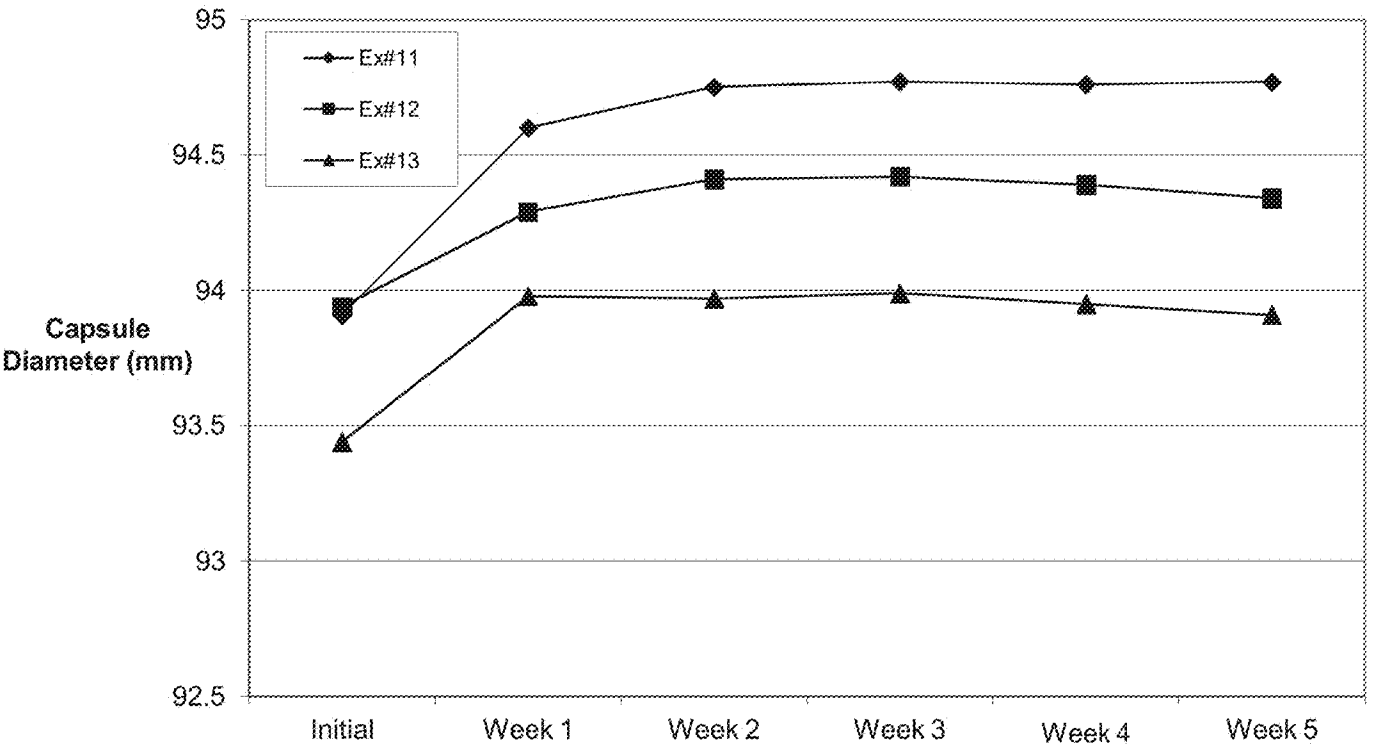
FIG. 6 is a line graph illustrating capsule growth of embodiments of the invention set forth in the Examples.

The containers containing the capsules were then heated and measured as described with respect to Examples 1-6. FIGS. 5 and 6 are line graphs showing the results, which indicate that Examples 12 and 13, which contained a saccharide, exhibited reduced diameter increase and swelling compared to control Example 11. In particular, Examples 12 and 13 experienced about 0.5% or less swelling over the five week storage period.

Although the present invention has been described with reference to preferred embodiments, workers skilled in the art will recognize that changes may be made in form and detail without departing from the spirit and scope of the invention.

The invention claimed is:

1. A solid detergent composition comprising:

from about 40 wt % to about 60 wt % of at least one alkali metal silicate;

from about 0.5 wt % to about 3 wt % of at least one saccharide or sugar alcohol;

from about 20 wt % to about 40 wt % water; and from about 3 wt % to about 15 wt % of at least one polycarboxylic acid polymer;

wherein the at least one saccharide comprises sucrose, fructose, inulin, lactulose or maltose;

wherein said composition is phosphorus free; and wherein if the composition is heated at a temperature of 120° F., the solid detergent composition is dimensionally stable and has a growth exponent of less than 1.5% for at least about 3 weeks.

2. The composition of claim 1, wherein the at least one saccharide comprises sucrose.

3. The composition of claim 1 wherein the at least one sugar alcohol comprises sorbitol.

4. The composition of claim 1, wherein the at least one polycarboxylic acid polymer comprises at least one maleic acid polymer, at least one acrylic acid polymer or combinations thereof.

5. The composition of claim 1, further comprising sodium carbonate, wherein the alkali metal silicate is present in a greater amount than the sodium carbonate.

6. The composition of claim 1, further comprising from about 15 wt % to about 40 wt % of sodium carbonate.

7. A method of forming a solid detergent composition according to claim 1, the method comprising:

combining the at least one alkali metal silicate, the at least one saccharide or sugar alcohol, the at least one polycarboxylic acid polymer, and water to form a mixture; and forming a solid detergent composition from the mixture.

8. The method of claim 7, further comprising the step of forming the solid detergent composition into a block, capsule, pellet or tablet.

9. A method of cleaning a substrate, the method comprising:

mixing water with a solid detergent composition according to claim 1 to form a use solution, wherein the use solution comprises:

from about 10 ppm to about 1000 ppm of the at least one alkali metal silicate; from about 5 ppm to about 200 ppm of the at least one saccharide or sugar alcohol; from about 10 ppm to about 200 ppm of the at least one polycarboxylic acid polymer; and contacting the substrate with the use solution.

10. A solid detergent composition comprising:

from about 30 wt % to about 60 wt % of at least one alkali metal silicate;

from about 0.5 wt % to about 3 wt % of at least one saccharide comprising sucrose or at least one sugar alcohol comprising sorbitol;

from about 20 wt % to about 40 wt % sodium carbonate;

from about 20 wt % to about 40 wt % water; and from about 3 wt % to about 15 wt % of at least one polycarboxylic acid polymer;

wherein said composition is phosphorus free; and wherein if the composition is heated at a temperature of 120° F., the solid detergent composition is dimensionally stable and has a growth exponent of less than 0.6% for at least about 3 weeks.

11. The composition of claim 10, wherein the at least one polycarboxylic acid polymer comprises at least one maleic acid polymer, at least one acrylic acid polymer or combinations thereof.

* * * * *